US009835121B2

(12) United States Patent
Tagawa et al.

(10) Patent No.: US 9,835,121 B2
(45) Date of Patent: Dec. 5, 2017

(54) SYSTEM FOR SUPPLYING FUEL TO AN ENGINE

(71) Applicant: AISAN KOGYO KABUSHIKI KAISHA, Obu-shi, Aichi-ken (JP)

(72) Inventors: Naoyuki Tagawa, Nagoya (JP); Minoru Akita, Ama (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 28 days.

(21) Appl. No.: 14/855,794

(22) Filed: Sep. 16, 2015

(65) Prior Publication Data

US 2016/0076495 A1 Mar. 17, 2016

(30) Foreign Application Priority Data

Sep. 17, 2014 (JP) ..... 2014-188536

(51) Int. Cl.
*F02M 37/00* (2006.01)
*F02M 37/08* (2006.01)
(Continued)

(52) U.S. Cl.
CPC ..... *F02M 37/08* (2013.01); *F02D 33/006* (2013.01); *F02D 41/061* (2013.01);
(Continued)

(58) Field of Classification Search
CPC ..... F02M 37/08; F02M 2037/087; F02D 41/3809; F02D 41/061; F02D 41/3082;
(Continued)

(56) References Cited

U.S. PATENT DOCUMENTS 4,433,650 A * 2/1984 Amano ..... F02D 41/062 123/179.17
5,327,872 A * 7/1994 Morikawa ..... F02B 33/446 123/179.17
(Continued)

FOREIGN PATENT DOCUMENTS

JP 2007132191 A 5/2007
JP 2008-14183 A 1/2008
(Continued)

OTHER PUBLICATIONS

Japanese Office Action dated Aug. 23, 2017, for Japanese Application No. 2014-188536 (2 p.).
(Continued)

*Primary Examiner* — Carlos A Rivera
*Assistant Examiner* — Sherman Manley
(74) *Attorney, Agent, or Firm* — Conley Rose, P.C.

(57) ABSTRACT

A fuel-supply system has a fuel pump, a pressure controller, a signal output device and a power switch. The pressure controller adjusts the observed fuel pressure of the fuel and may electronically communicate with a motor driving the fuel pump to regulate the supply of fuel from a fuel tank of the fuel-supply system to an engine. In detail, the pressure controller performs feedback control of a voltage applied to the motor such that the pressure of a fuel pumped from the fuel pump approaches to have a first target and/or ideal fuel pressure value. Further, the signal output device outputs the first target fuel pressure value to the pressure controller. Activation of the power switch supplies power, from a power source, to the pressure controller, the motor and the signal output device. Further, the pressure controller may perform feedback control based on a second target fuel pressure value.

7 Claims, 9 Drawing Sheets

(51) Int. Cl.

| | |
|---|---|
| ***F02D 41/06*** | (2006.01) |
| ***F02D 41/38*** | (2006.01) |
| ***F02D 33/00*** | (2006.01) |
| *F02D 41/30* | (2006.01) |

(52) U.S. Cl.
CPC ..... *F02D 41/3809* (2013.01); *F02D 41/3082* (2013.01); *F02D 2200/0602* (2013.01); *F02D 2250/31* (2013.01); *F02M 2037/087* (2013.01)

(58) Field of Classification Search
CPC ..... F02D 33/006; F02D 2250/31; F02D 2200/0602
See application file for complete search history.

(56) References Cited

U.S. PATENT DOCUMENTS

| | | | | |
|---|---|---|---|---|
| 5,749,344 | A * | 5/1998 | Yoshiume | F02D 41/3082 123/399 |
| 5,771,861 | A * | 6/1998 | Musser | F02D 41/1401 123/357 |
| 6,450,148 | B2 * | 9/2002 | Nakamura | F02D 41/3082 123/464 |
| 8,205,596 | B2 | 6/2012 | Kieferle et al. | |
| 8,844,503 | B2 * | 9/2014 | Worthington | F02M 37/22 123/446 |
| 2003/0221675 | A1 * | 12/2003 | Washeleski | B60K 15/03504 123/497 |
| 2012/0306416 | A1 * | 12/2012 | Hano | B60L 1/003 318/400.26 |
| 2014/0174403 | A1 * | 6/2014 | Akita | F02D 41/3082 123/446 |
| 2014/0299103 | A1 * | 10/2014 | Yanoto | F02D 41/064 123/447 |
| 2015/0007798 | A1 * | 1/2015 | Cho | F02M 69/02 123/495 |

FOREIGN PATENT DOCUMENTS

| | | | |
|---|---|---|---|
| JP | 2009-540205 | A | 11/2009 |
| JP | 2011122600 | A | 6/2011 |
| JP | 2014-122585 | A | 7/2014 |

OTHER PUBLICATIONS

English Translation of Japanese Office Action dated Aug. 23, 2017, for Japanese Application No. 2014-188536 (2 p.).

* cited by examiner

| TIME (ms) ELAPSED AFTER SUPPLY OF ELECTRIC POWER | 20 | 40 | · · · | A |
|---|---|---|---|---|
| MOTOR DUTY RATIO (%) | 30 | 35 | · · · | 50 |

| DIFFERENCE E(kPa) FROM PROVISIONAL TARGET FUEL PRESSURE Ps / PROVISIONAL TARGET FUEL PRESSURE Ps(kPa) | 50 | 100 | 150 | ··· | 600 |
|---|---|---|---|---|---|
| 300 | 30 | 32.5 | 35 | ··· | 50 |
| 400 | 40 | 42.5 | 45 | ··· | 60 |
| 500 | 50 | 52.5 | 55 | ··· | 70 |
| 600 | 60 | 62.5 | 65 | ··· | 80 |

SYSTEM FOR SUPPLYING FUEL TO AN ENGINE

CROSS-REFERENCE TO RELATED APPLICATIONS

This application is based upon and claims priority to Japanese Patent Application Serial No. 2014-188536 filed on Sep. 17, 2014, the contents of which are incorporated in their entirety herein by reference in their entirety for all purposes.

STATEMENT REGARDING FEDERALLY SPONSORED RESEARCH OR DEVELOPMENT

Not applicable.

BACKGROUND

The disclosure generally relates to a system for supplying fuel to an engine, e.g., an internal combustion engine that powers a vehicle such as an automobile. More particularly, the disclosure relates to a fuel supply system in which a pre-determined voltage is applied to an electric motor configured to drive a pump in the system where the pump may be feedback controlled such that an actual and/or observed fuel pressure throughout the system approaches a target and/or ideal fuel pressure.

Readily available fuel-supply systems may include those disclosed by U.S. Patent Application Publication No. 2014/0174403 (also published as Japanese Laid-Open Patent Publication No. 2014-122585). Such a fuel-supply system supplies fuel stored in a fuel tank to an engine in communication with the fuel tank by varying pressure across the system, i.e. such that a fluid, such as the stored fuel, may flow from the fuel tank to the engine as desired. In detail, the fuel supply system includes a fuel pump driven by a motor and a pressure controller that controls fuel pressure while the fuel is distributed throughout the fuel system by the fuel pump. Moreover, the pressure controller may control fuel pressure upon receiving feedback from the fuel system, i.e. referred to in the art as "feedback control." Such feedback control adjusts the fuel pump as necessary to ensure that an actual and/or observed fuel pressure approaches a target and/or ideal fuel pressure value. To assist in the fuel system performing feedback control as described here, an engine control unit ("ECU") transmits a signal representing a target fuel pressure value to the pressure controller. Further, a power supply device, such as a battery, may supply electric power to the ECU, the motor and the pressure controller when a power switch, such as an ignition switch of an automobile, is activated.

As often associated with currently available fuel-supply systems, and also that shown by an exemplary embodiment of the current disclosure in FIG. 11 herein, a pressure controller may not receive target fuel pressure information, i.e. a signal, during a "wait" and/or "delay" period Ams, such as between time T0 and T1 immediately following ignition of the engine. This delay of the target fuel pressure signal may result from a lack of preparation of the ECU as needed to transmit the target fuel pressure value signal until said time T1. Thus, during the period Ams, the controller may not be able to perform feedback control based on a target fuel pressure value. Accordingly, during the period Ams as shown by FIG. 11, a ratio of voltage applied to the fuel pump motor (hereinafter referred to as a "motor duty ratio") may be set to a maximum possible value (see a lower portion of FIG. 11) that takes into account the relative ease of activating the engine, etc. Nevertheless, should the motor duty ratio be set to the maximum value as described here, the fuel pump may respond to such a maximum setting by overshooting a desired and/or target fuel pressure, or otherwise cause undesirable increases in power consumption across the fuel-supply system.

In view of the above, there is a current need in the art for a fuel-supply system that controls fuel pressure across the system until a target fuel pressure value signal is received after the motor is started.

SUMMARY

A fuel-supply system as disclosed in an embodiment may have various components, including a fuel pump, a pressure controller, a signal output device and a power switch. A motor may drive and/or operate the fuel pump to supply, i.e. by pressure-feeding, fuel stored within a fuel tank to an engine. The pressure controller may continually adjust the fuel pump in accordance with feedback received from throughout the fuel-supply system, i.e. "feedback" control, when a particular voltage is applied to the motor driving the fuel pump. In detail, application of such a voltage may cause fuel to be distributed throughout the fuel-supply system by the fuel pump such that the fuel has a first target fuel pressure value. The signal output device may output the first target fuel pressure value to the pressure controller. The power switch may supply electric power from a power source to the pressure controller, the motor and the signal output device when the power switch is turned on. The pressure controller may be further configured to perform feedback control, as described here, of the voltage applied to the motor upon receiving a second target fuel pressure value (i.e., a provisional target fuel pressure value) until a predetermined target condition, such as when the first target fuel pressure value is outputted from the signal output device to the pressure controller after the power switch of the fuel-supply system is activated.

As in the arrangement of the fuel-supply system described above, in comparison with an arrangement where the duty ratio of the motor is set to a maximum value until when the first target fuel pressure value is outputted from the signal output device to the pressure controller after the power switch of the fuel-supply system is activated, the fuel-supply system may effectively inhibit potential overshooting of a desired fuel pressure with respect to the first target fuel pressure. In addition, power consumption of the motor may be reduced.

In an embodiment, the pressure controller may be further configured to determine the second target fuel pressure value to be equal to the target fuel pressure value that was outputted from the signal output device to the pressure controller at a time immediately prior to when the power switch had been turned off most recently, i.e. when the power switch was turned off at the last occasion. Such a configuration may reduce variance between the second target fuel pressure and the first target fuel pressure as received from the signal output device. Thus, the fuel-supply system, configured as described here may further reliably inhibit potential overshooting of the fuel pressure with respect to the first target fuel pressure.

In an embodiment, the pressure controller may be configured to determine the second target fuel pressure to be equal to the target fuel pressure value that was first outputted from the signal output device to the pressure controller at a time after the power switch had been turned on most recently, i.e. at the last occasion. Also, the fuel-supply system, configured as described here may reduce variance between the second target fuel pressure and the first target fuel pressure that will be received from the signal output device.

In an embodiment, the pressure controller may be configured to determine the second target fuel pressure based on, for example: (1) the target fuel pressure value that was outputted from the signal output device to the pressure controller at a time immediately prior to when the power switch had been turned off most recently, i.e. at the last occasion; and (2) the target fuel pressure value that was first outputted from the signal output device to the pressure controller at a time after the power switch has been turned on most recently, i.e. at the last occasion. Also, the fuel-supply system, configured as described herein may reduce variance in the second target fuel pressure and the first target fuel pressure that will be received from the signal output device.

In another embodiment, the pressure controller may be configured to set the duty ratio, as described earlier, of the voltage applied to the motor to a set value until an actual and/or an observed fuel pressure reaches the second fuel pressure value after the power switch is turned on. The set value may be determined according to a time elapsed after the power switch is turned on. Such an arrangement as described here may allow the fuel-supply system to avoid the duty ratio of the voltage applied to the motor from increasing to a maximum value, even in circumstances where a difference between the second target fuel pressure value and an actual and/or an observed fuel pressure measured upon discharge and/or distribution from the fuel pump powered by the motor is relatively large.

In yet another embodiment, the set value may be determined based on the second target fuel pressure value and a difference between an actual and/or an observed fuel pressure and the second target fuel pressure value. Also, the fuel-supply system may be configured to avoid increasing the duty ratio of the voltage applied to the motor to a maximum value, even where a difference between the second target fuel pressure value and an actual and/or an observed fuel pressure discharged from the motor is relatively large.

DETAILED DESCRIPTION

A fuel-supply system 10 according to a first embodiment will now be described with reference to FIGS. 1 to 4. The fuel-supply system 10 may supply fuel F stored in a fuel tank T to an engine EG of a motor vehicle, such as an automobile. Specifically, the engine EG may be a conventional internal combustion engine.

Figure 1:
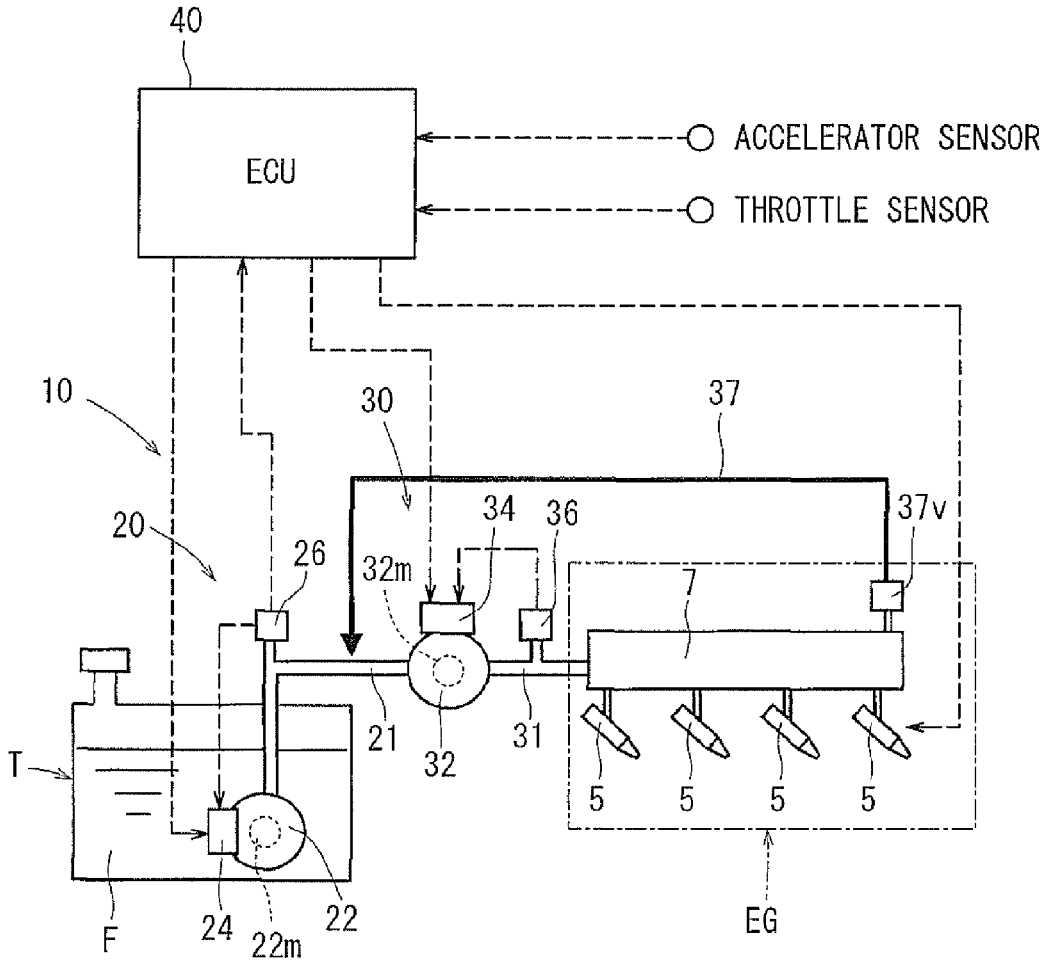
FIG. 1 is a schematic view of a fuel supply system according to a first embodiment.

Referring to FIG. 1, the fuel-supply system 10 may have a low-pressure fuel pump unit 20 connected in series with a high-pressure fuel pump 30 to, for example, effectively regulate fuel pressure across the fuel-supply system 10 as desired. An engine control unit (ECU) 40 may transmit one or more control signals to the low-pressure fuel pump unit 20 and the high-pressure fuel pump 30, so that a pressure of the fuel F distributed, discharged and/or pumped from the low-pressure fuel pump unit 20 and a pressure of the fuel F similarly discharged from the high-pressure fuel pump 30 may be controlled based on the control signals. A battery (not shown in the FIGs.) may supply electric power to the low-pressure fuel pump 20, the high-pressure fuel pump 30 and the ECU 40 when an ignition switch (not shown in the FIGs.) of the automobile is activated, i.e. turned on. Accordingly, the battery may function as a power source for supplying electric power to the low-pressure fuel pump 20, the high-pressure fuel pump 30 and the ECU 40. Likewise, the ignition switch, as described here, may serve as a power switch associated with the power source, allowing for the power source to be turned on and off as needed.

The low-pressure fuel pump unit 20 may pressurize the fuel F to reach a predetermined pressure and may also supply, i.e. pump, the pressurized fuel F to the high-pressure fuel pump unit 30. A low-pressure fuel supply pipe 21 may extend from the low-pressure fuel pump unit 20 to connect with the high-pressure fuel pump unit 30 as shown in at least FIG. 1. The low-pressure fuel pump unit 20 may include a fuel pump 22 positioned inside the fuel tank T, a motor 22*m* for driving the fuel pump 22, a low-pressure controller 24 for controlling the motor 22*m* based on a control signal transmitted from the ECU 40, and a pressure sensor 26 attached to the low-pressure fuel supply pipe 21. The pressure sensor 26 may detect a pressure P of the fuel F discharged from and/or pumped through the fuel pump 22 (hereinafter referred to as "fuel pressure P"). Further, the low-pressure controller 24 may control fuel pressure and/or a fuel flow rate throughout the fuel-supply system 10 by, for example, according to a pulse width modulation (PWM) control in which a duty ratio of a voltage applied to the motor 22*m* from the battery is adjusted. In detail, the low-pressure controller 24 may perform a feedback control of such a duty ratio of a voltage applied to the motor 22*m* from the battery to ensure that the fuel pressure P of fuel discharged from and/or pumped through the fuel pump 22 approaches a target and/or ideal fuel pressure value Pe. To assist in attaining a target fuel pressure value Pe as described here, the ECU 40 may output a signal representing the target fuel pressure value Pe to the low-pressure controller 24. In detail, the ECU 40 may calculate the target fuel pressure value Pe based on various electronic detection signals, such as electronic detection signals output from an accelerator sensor and/or a throttle sensor configured to, for example, sense acceleration of a vehicle and amount of intake air supplied to the engine, respectively.

The high-pressure pump unit 30 may increase the fuel pressure P of the fuel F supplied and/or pumped from the low-pressure pump unit 20 and may supply the fuel F with an increased fuel pressure F, as described here, to the engine EG. In particular, the high-pressure pump unit 30 may connect to a fuel delivery pipe 7 of the engine EG via a high-pressure fuel supply pipe 31. Similar to that described earlier for the low-pressure pump unit 20, the high-pressure pump unit 30 may include a fuel pump 32, a motor 32*m* for driving the fuel pump 32, a high-pressure controller 34 for controlling the motor 32*m* based on a control signal transmitted from the ECU 40, and a pressure sensor 36 attached to the high-pressure fuel supply pipe 31. The pressure sensor 36 may detect the fuel pressure P of the fuel F discharged from and/or pumped by the fuel pump 32. The fuel F supplied from the high-pressure pump unit 30 to the fuel delivery pipe 7 of the engine EG may be injected to combustion chambers (not shown in the FIGs.) of the engine EG via injectors 5. Excess fuel not injected from the injectors 5 as described here may return from the fuel delivery pipe 7 to the low-pressure fuel supply pipe 21 via a valve 37*v* and a return pipe 37.

Figure 2:
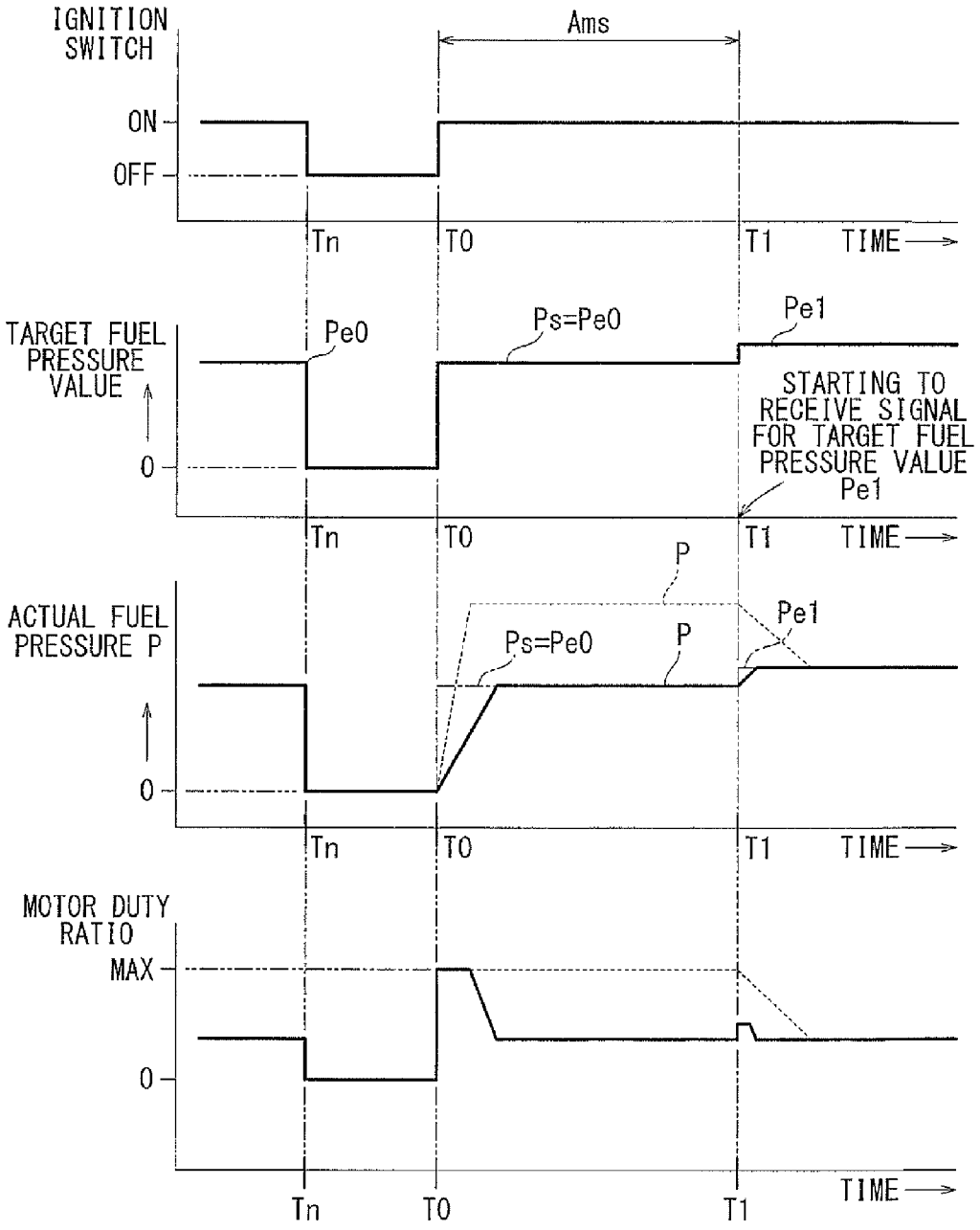
FIG. 2 is a graph showing a relationship between a target fuel pressure value, an actual and/or an observed fuel pressure, a duty ratio of a motor of a fuel pump, and an operation of an ignition switch in a fuel pressure control performed by the fuel supply system.

Methods and processes related to controlling fuel pressure P by the low-pressure fuel pump unit 20 immediately after the ignition switch has been turned on will now be described with reference to a graph (specifically, a time chart) as shown in FIG. 2 and a flowchart shown as in FIG. 3. The low-pressure controller 24 may include a microcomputer (not shown in the FIGs.) with memory able to store a program, so that the low-pressure controller 24 may repeatedly perform a process according to the flowchart shown in FIG. 3 with a predetermined cyclic period according to the stored program. Referring to FIG. 2, the ignition switch may be turned on at time T0 to allow the battery to supply electric power to the ECU 40, the low-pressure controller 24 and the motor 22*m* of the fuel pump 22 to allow the aforementioned components to operate. However, during a period Ams immediately after activation of, i.e. turning on, the ignition switch, the low-pressure controller 24 may be relatively unprepared to receive a signal representing a target fuel pressure value Pe1 from the ECU 40. Also, the ECU 40 may otherwise be unprepared to transmit the target fuel pressure value Pe1 signal during this period Ams. Alternatively described, the ECU 40 may transmit the target fuel pressure value Pe1 signal to the low-pressure controller 24 only after time T1 at the end of the period Ams shown in FIG. 2. Likewise, the low-pressure controller 24 may receive the target fuel pressure value Pe1 signal from the ECU 40 also only after time T1 at the end of the period Ams and thus not be able to perform feedback control of the fuel pressure P based on the target fuel pressure value Pe1 until time T1, i.e. the time when the low-pressure controller 24 receives information regarding the target fuel pressure value Pe1 from the ECU 40. In further detail, in an embodiment, the period Ams may range from about 100 ms to about 200 ms.

Figure 3:
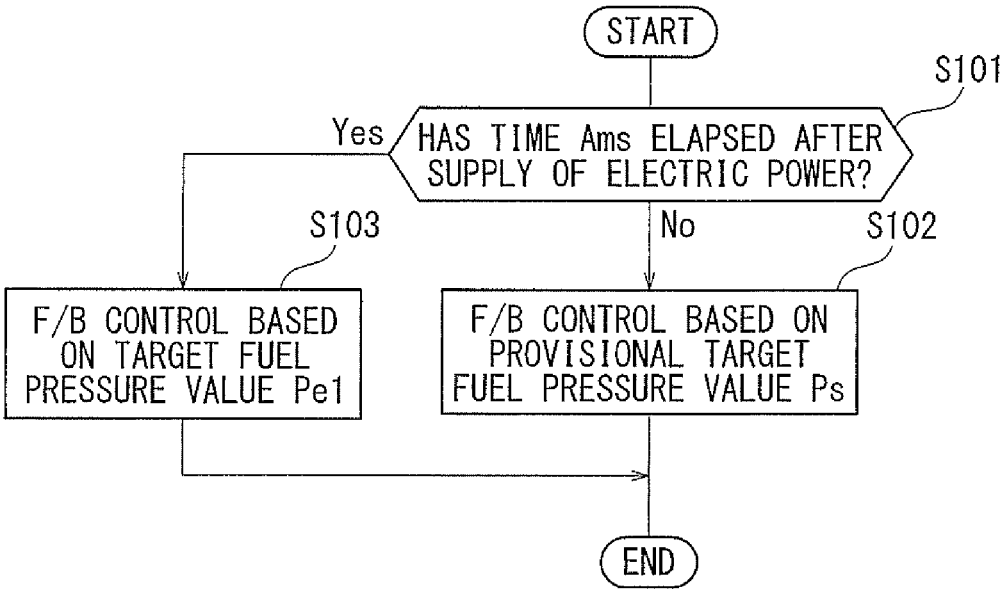
FIG. 3 is a flowchart illustrating a fuel pressure control process performed by the fuel supply system.

As shown in FIG. 3, a microcomputer (not shown in the FIGs.) of the low-pressure controller 24, at Step 101, may select from, i.e. make a determination regarding, "Yes" or "No" on whether the condition specified by Step 101 has been satisfied, namely on whether time Ams has elapsed after initiation of electric power supply to the fuel-supply system 10, i.e. where the period Ams may be defined as between time T0 and time T1. With a determination of "No," as described here, the process shown by FIG. 3 may proceed to Step S102. The ECU 40, in conjunction with the low-pressure controller 24 and/or the high-pressure controller 34, along with various other associated components of the fuel-supply system 10 as described earlier, may receive process feedback information to perform feedback control of a duty ratio of a voltage applied to the motor 22*m* (hereinafter called "motor duty ratio") such that the fuel pressure P approaches to equal a provisional target fuel pressure value Ps. Alternatively, and as discussed earlier, a determination at Step 101 may be "Yes" upon elapse of the period Ams after turning on the ignition switch to allow the process shown by FIG. 3 to proceed to Step S103. Different from that described earlier for Step 102, the ECU 40, along with the various other components of the fuel-supply system 10 described earlier, may perform feedback control based on information regarding the motor duty ratio such that fuel pressure P of fuel in the fuel-supply system 10 approaches to equal the target and/or ideal fuel pressure value Pe1, rather than the provisional target fuel pressure value Ps.

As shown in the center of FIG. 2, i.e. the second and third charts from the top, the provisional target fuel pressure value Ps may be set to equal a target fuel pressure value Pe0. The target fuel pressure value Pe0 may be a target fuel pressure value that was already transmitted from the ECU 40 to the low pressure controller 24 prior to time Tn when the ignition switch is deactivated, i.e. turned from on to off, most recently, i.e. at the last occasion. Accordingly, the provisional target fuel pressure value Pe0 may be relatively nearer to the target fuel pressure value Pe1 which will be transmitted from the ECU 40 after time T1. During feedback control of the fuel pressure P based on the provisional target fuel pressure value Ps, the motor duty ratio (the duty ratio of the motor 22*m*) may temporarily approach a maximum allowable value should a difference between the provisional target fuel pressure value Ps and the fuel pressure P (actual fuel pressure as measured and/or observed) is relatively large. However, the difference between the provisional target fuel pressure value Ps and the fuel pressure P may decrease, for example, with time after activation of the driving of the fuel pump 22. Thus, the motor duty ratio may soon recede from the maximum value. As a result, in comparison with where the motor duty ratio is set at a maximum value during the period Ams (between time T0 and time T1) as indicated by dotted lines in the third chart from the top as shown in FIG. 2, the ECU 40 may control, such as by performing feedback control, the fuel-supply system 10 to inhibit potential overshooting of the fuel pressure P. In addition, such a configuration as described here may allow for relative reduction in power consumption of the motor 22*m* during operation.

As introduced earlier, the low-pressure controller 24 may control fuel pressure P throughout the fuel-supply system 10 by performing feedback control based on the provisional target fuel pressure value Ps until the low-pressure controller 24 receives the target fuel pressure value Pe1 signal from the ECU after the ignition switch has been activated. Also, the provisional target fuel pressure value Ps may be set to equal the target fuel pressure value Pe0, a signal of which was transmitted from the ECU 40 to the low pressure controller 24 just before the ignition switch is turned off most recently, i.e. at the last occasion. Thus, in comparison with a case where the motor duty ratio may be set at a possible maximum until the low-pressure controller 24 receives the target fuel pressure value Pe1 signal from the ECU after the ignition switch has been turned on, potential overshooting of the target fuel pressure value Pe1 may be inhibited as shown in, for example, the third chart from the top in FIG. 2. In addition, the power consumption of the motor 22*m* may be reduced during operation.

Figure 4:
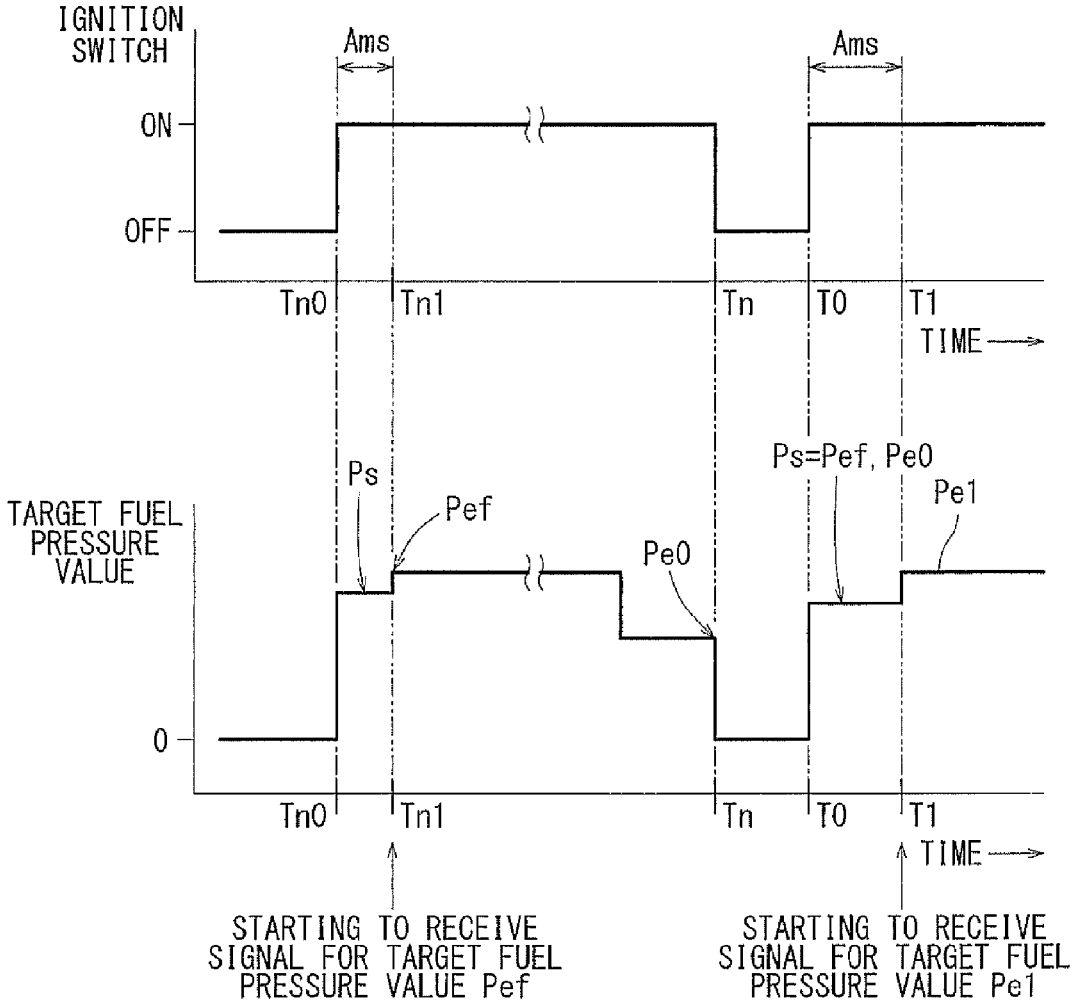
FIG. 4 is a graph showing a relationship between a target fuel pressure value and an operation of an ignition switch in a fuel pressure control performed by a fuel supply system according to a second embodiment that is a modification of the first embodiment.

The first embodiment as described above may be further modified in various ways not specifically enumerated herein, yet still remain within the original scope and spirit of the disclosure. For example, a second embodiment, different from the first embodiment, may set the provisional target fuel pressure value Ps to be equal to a target fuel pressure value Pef, as shown in FIG. 4, a signal of which was transmitted from the ECU 40 to the low pressure controller 24 at time Tn1 after time Tn0 when the ignition switch is turned from off to on most recently, i.e. at the last occasion. Thus, even in the event that a specific type of engine control, such as a warm-up control and/or a correction control for engine cooling water, is performed at the time of starting the automobile engine, the ECU 40, as configured in conformance with that disclosed in the second embodiment, may be configured to set the provisional target fuel pressure value Ps to be closer to the target fuel pressure value Pe0 that will be received from the ECU 40 most recently, i.e. at the latest occasion. Also, the provisional target fuel pressure value Ps may be set based on the target fuel pressure value Pef and the target fuel pressure value Pe0 (a signal of which was transmitted from the ECU 40 to the low pressure controller 24 just before time Tn when the ignition switch is turned off at the last occasion as described in the first embodiment). In detail, the provisional target fuel pressure Ps may be set to equal a mean value of the target fuel pressure value Pef and the target fuel pressure value Pe0. Moreover, the provisional target fuel pressure Ps may be set to a value calculated by various means, such as by multiplying or dividing the target fuel pressure value Pef or the target fuel pressure value Pe0 by a predetermined constant value. Accordingly, the provisional target fuel pressure value Ps may be determined based on the target fuel pressure value Pef.

The fuel-supply system 10 according to a third embodiment will now be described with reference to FIGS. 5 to 7. The fuel-supply system 10 according to the third embodiment may include a further modifications of the fuel-supply system 10 from that described earlier with regard to the first embodiment and may thus differ from the first embodiment in control performed based on the provisional fuel pressure value Ps (i.e., the control during the period Ams between time T0 and time T1). In other respects regarding the operation of the fuel-supply system 10 in regulating and/or maintaining the fuel pressure value P, the third embodiment may be substantially identical to that discussed earlier for the first embodiment.

Figure 5:
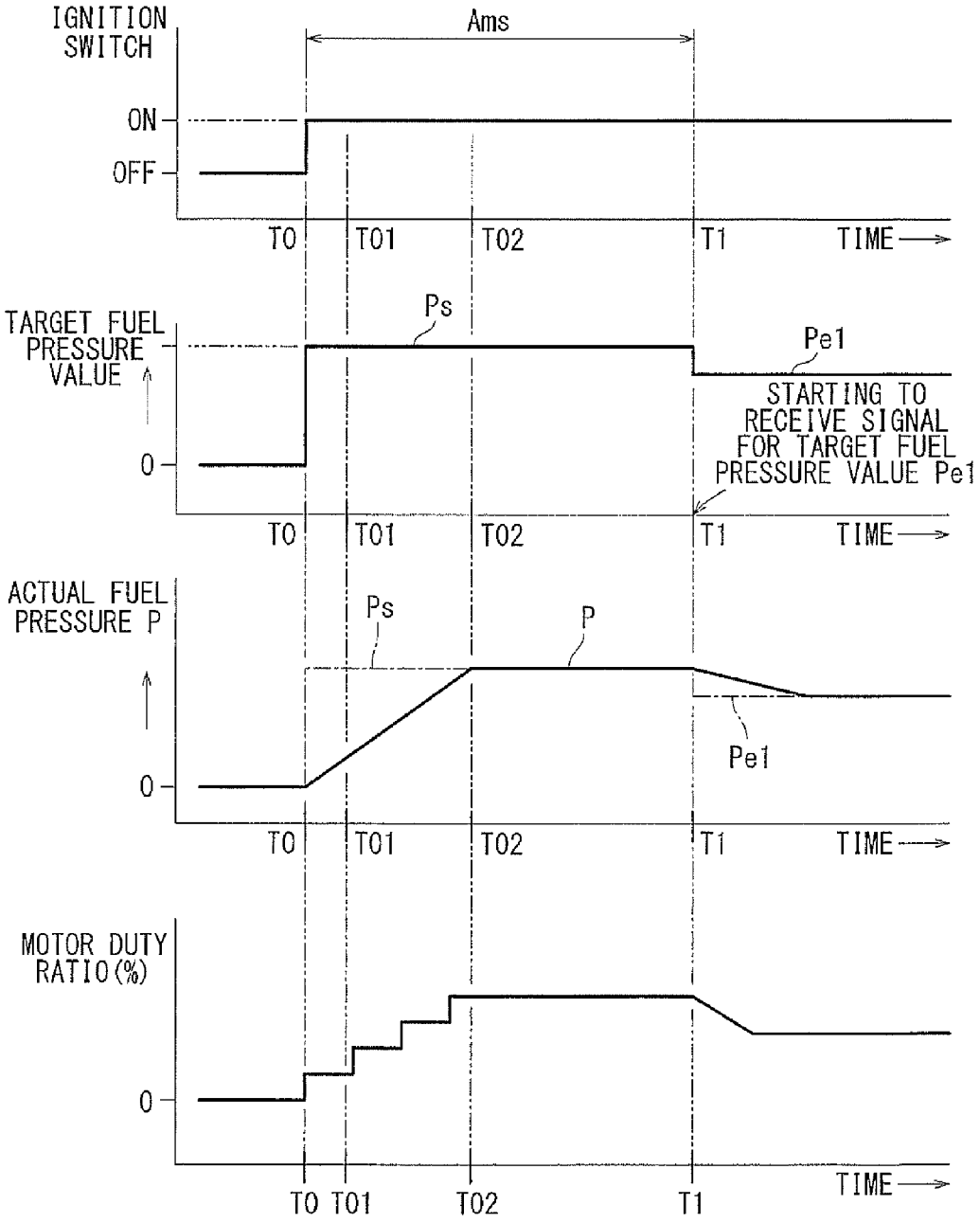
FIG. 5 is a graph showing a relationship between a target fuel pressure value, an actual and/or observed fuel pressure, a duty ratio of a motor of a fuel pump, and an operation of an ignition switch in a fuel pressure control performed by a fuel supply system according to a third embodiment.

As shown in FIG. 5, when the ignition switch is turned on at time T0, a microcomputer of the low-pressure controller 24 may set the provisional target pressure value Ps in a manner similar to that discussed for the first embodiment. Next the microcomputer may perform a process shown in the flowchart illustrated in FIG. 6. In detail, at time T01 after a predetermined time from time T0 and prior to elapse of the period Ams from time T0 as shown in FIG. 5, the actual and/or observed fuel pressure P may not have yet reached the provisional target fuel pressure value Ps. Thus, a determination at Step S201 shown in FIG. 6 may be "No", and a determination at Step S202 may be also "No." Next, the process shown in FIG. 6 may proceed to Step S203. Step S203 may set the duty ratio of the motor 22*m* of the fuel pump 22 to a preset value determined according to the time elapsed from time T0 when an electric power is supplied from the battery.

Figures 6, 7:
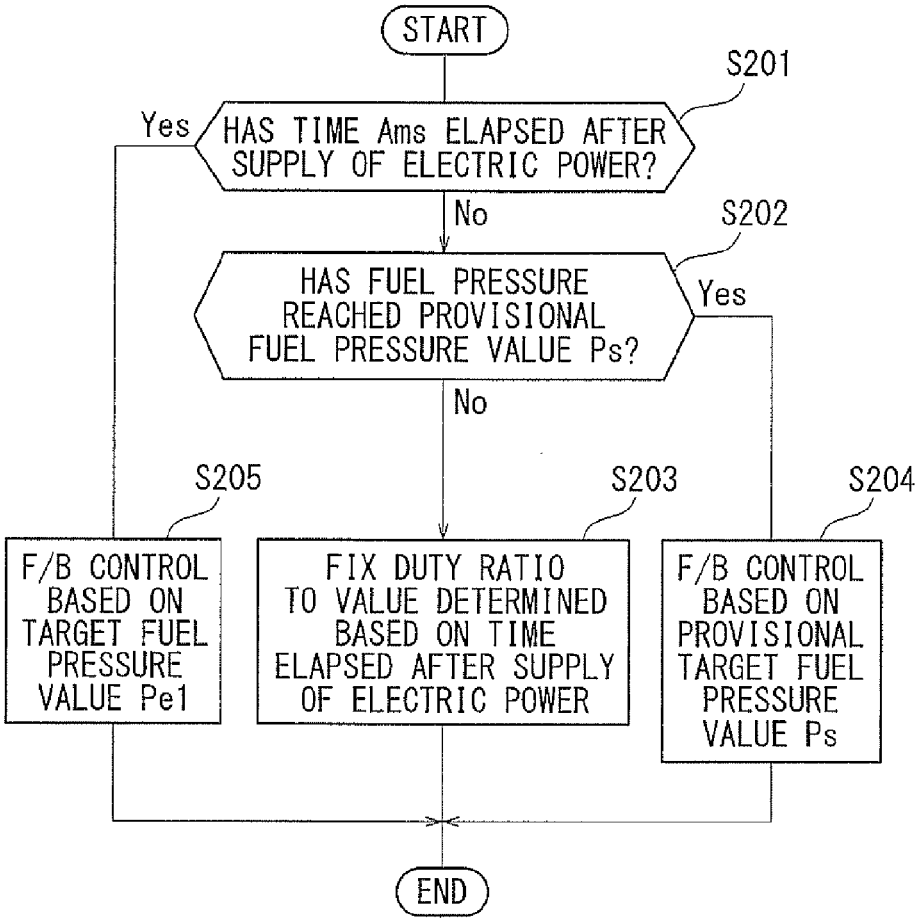
FIG. 6 is a flowchart illustrating a fuel pressure control process performed by the fuel supply system according to the third embodiment.
FIG. 7 is a table that may be used for setting the duty ratio of the motor in the fuel pressure control process shown in FIG. 6.

As shown in FIG. 7, the preset value of the duty ratio of the motor 22*m* may be determined according to the time elapsed from time T0. In detail, should time elapsed from time T0 be less than or equal to 20 ms, the motor duty ratio may be set to 30%. Alternatively, should the time elapsed from time T0 exceed 20 ms but be less than or equal to 40 ms, the motor duty ratio may be set to 35%. In such an instance, the preset value of the duty ratio may increase by 5% intervals corresponding to 20 ms intervals for the total time elapsed from time T0. In FIG. 7, the character "A" represents the time elapsed after initiation of supplying electric power to the various components of the fuel-supply system 10 as needed. In an embodiment, the time represented by A may exceed a predetermined value. Further, if the total elapsed time exceeds the time "A", the motor duty ratio may be set to a defined value, such as 50% as shown in FIG. 7. Alternatively described, 50% may be a maximum set value permissible by a given configuration of the fuel-supply system 10, i.e. as shown in the table of FIG. 7. In detail, the motor duty ratio may be set to 50% for the time between 80 ms and 100 ms where the time "A" may be set to be more than 100 ms. In such an instance, the low-pressure controller 24 may not perform a feedback control based on the provisional target fuel pressure value Ps, until time T01, before reaching the provisional target fuel pressure value Ps. Instead, the low-pressure controller 24 may drive the motor 22*m* of the fuel pump 22 with the preset duty ratio shown in FIG. 7.

Should the actual and/or observed fuel pressure P reach the provisional target fuel pressure value Ps at time T02 in FIG. 5, the determination at Step S202 may be "Yes", such that the low-pressure controller 24 may perform feedback control on the fuel-supply system 10 to control and/or regulate the fuel pressure P based on the provisional target fuel pressure value Ps at Step S204 in FIG. 6. Once the period Ams has elapsed after the ignition switch has been turned on at time T0, the determination at Step S201 may be "Yes", the process may proceed to Step S205, such that the low-pressure controller 24 may perform feedback control to maintain the fuel pressure P based on the target fuel pressure value Pe1 as transmitted from the ECU 40.

In detail, according to the third embodiment, the low-pressure controller 24 may not perform feedback control based on the provisional target fuel pressure value Ps until time T01 or T02 before the actual and/or observed pressure P reaches the provisional target fuel pressure value Ps. Instead, the low-pressure controller 24 may drive the motor 22*m* of the fuel pump 22 with a pre-set duty ratio. Thus, even in an instance where a difference between the provisional target pressure value Ps and the actual and/or observed fuel pressure P is relatively large, the duty ratio of the motor 22*m* may not increase to a maximum duty ratio of 100%.

Figure 8:
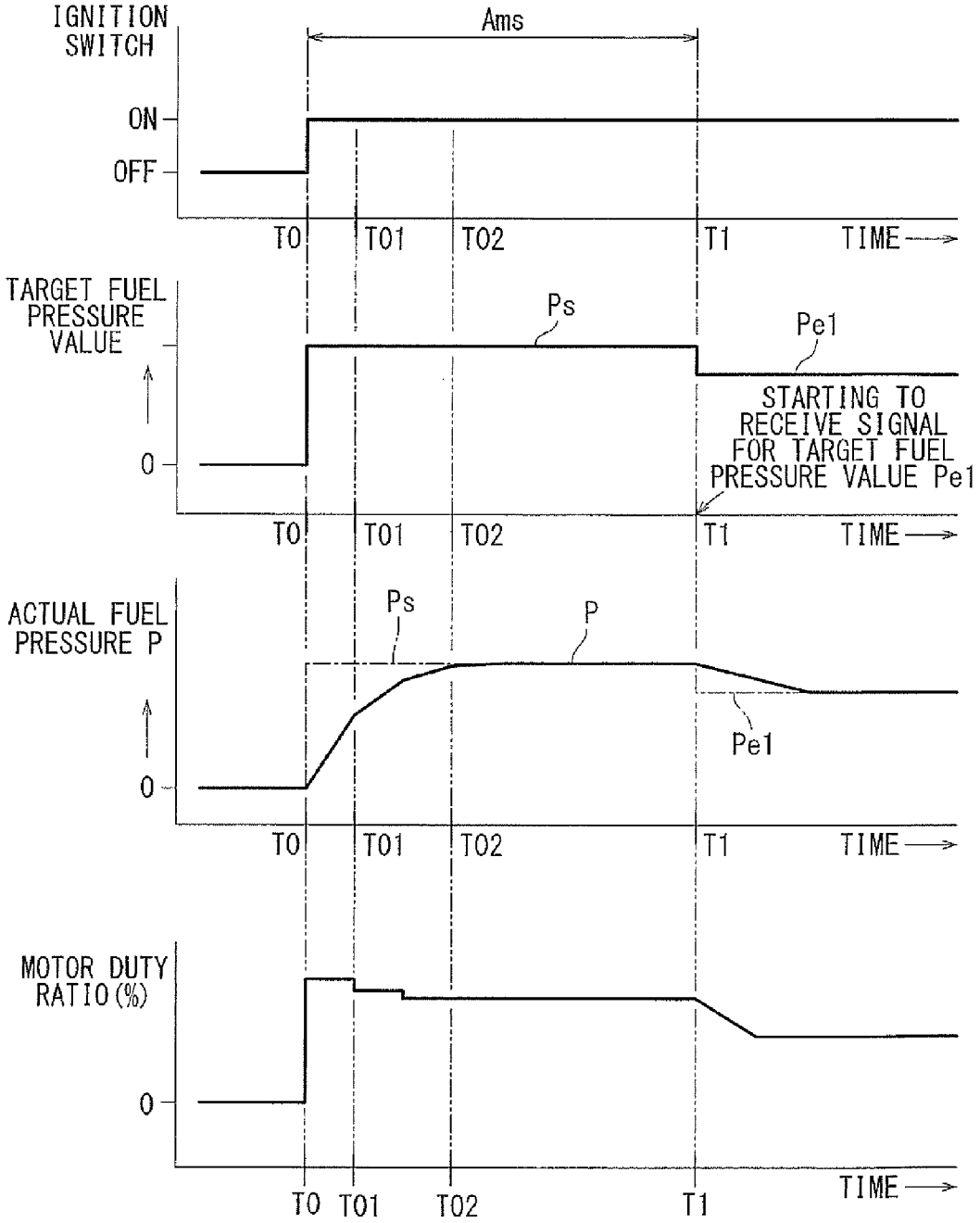
FIG. 8 is a graph showing a relationship between a target fuel pressure value, an actual and/or observed fuel pressure, a duty ratio of a motor of a fuel pump, and an operation of an ignition switch in a fuel pressure control performed by a fuel supply system according to a fourth embodiment.
Figures 9, 10:
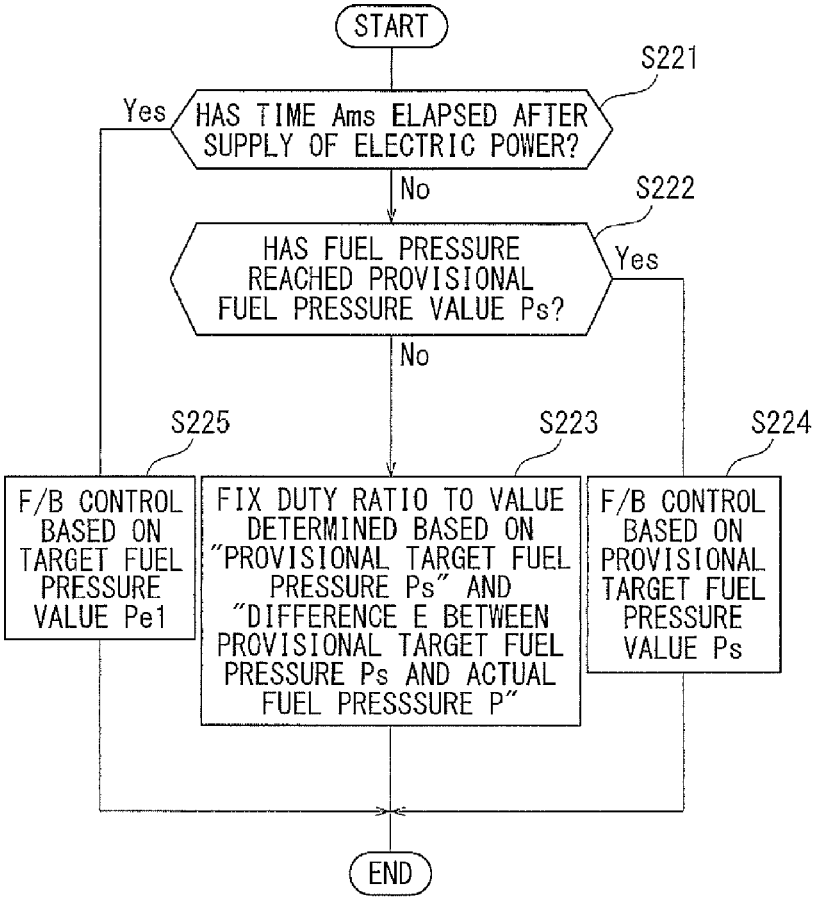
FIG. 9 is a flowchart illustrating a fuel pressure control process performed by a fuel supply system according to a fifth embodiment.
FIG. 10 is a table that may be used for setting the duty ratio of the motor in the fuel pressure control process shown in FIG. 9.
Figure 11:
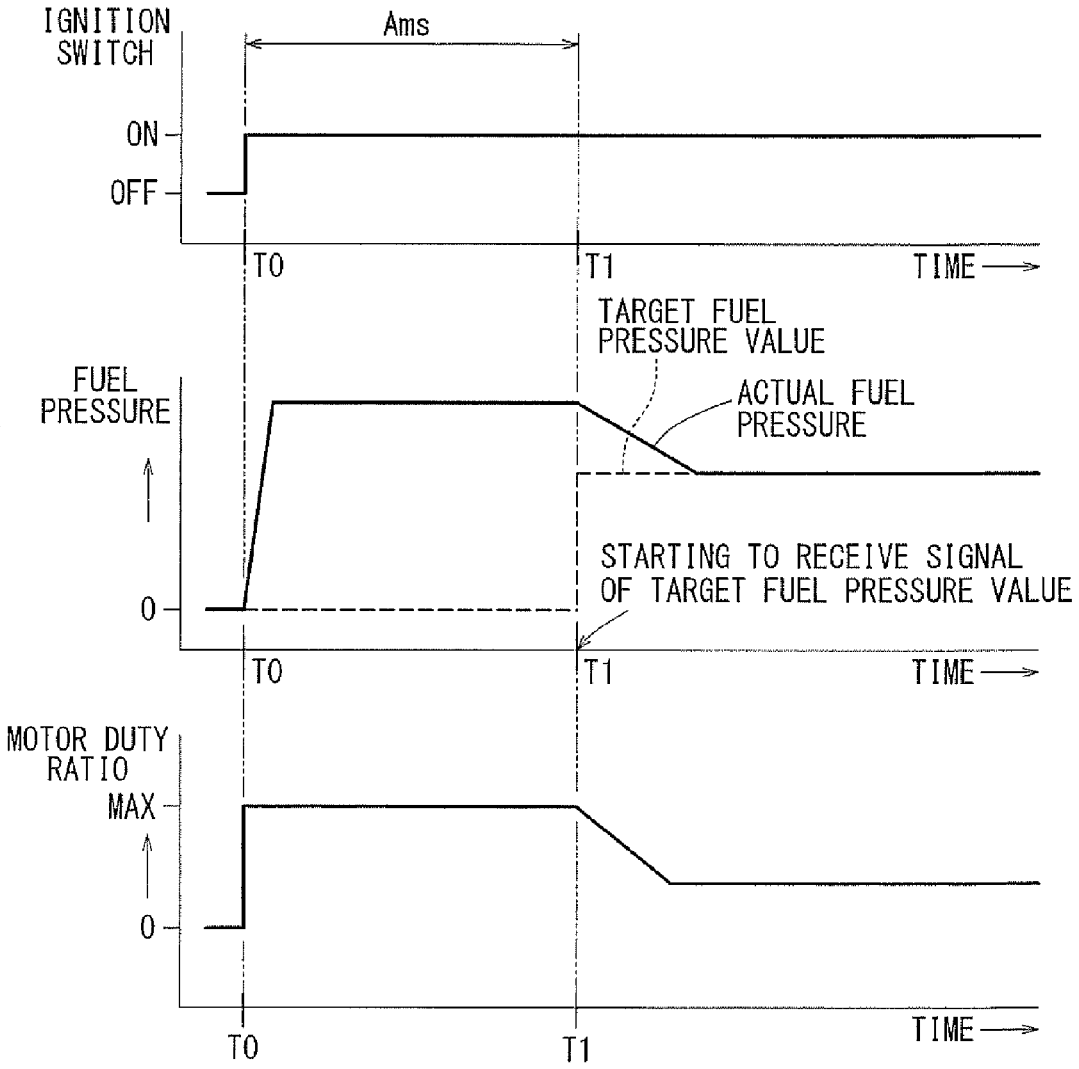
FIG. 11 RELATED ART
FIG. 11 is a graph showing a relationship between a target fuel pressure value, an actual and/or observed fuel pressure, a duty ratio of a motor of a fuel pump, and an operation of an ignition switch in a fuel pressure control performed by a fuel supply system according to a related art.

The third embodiment, as described above, may be further modified. In the third embodiment, the duty ratio of the motor 22*m* of the fuel pump 22 may be set to a preset value determined according to the time elapsed from time T0, i.e. when the ignition switch is activated. In contrast to that described by the third embodiment, the fourth embodiment, as shown in FIGS. 8 to 10, has a microcomputer of the low-pressure controller 24 calculating a difference E, as shown in FIG. 10, between the provisional target fuel pressure value Ps and the actual and/or observed fuel pressure P. In detail, the preset value of the duty ratio may be determined based on the difference E and the provisional target fuel pressure value Ps with reference to the table shown in FIG. 10. In the table shown in FIG. 10, for example, should the provisional target fuel pressure value Ps be less than or equal to 300 kPa and should the difference E be more than 100 Kpa but not more than 150 kPa, the duty ratio of the motor 22*m* may be set to 35%. Likewise, should the provisional target fuel pressure value Ps fall between 300 kPa and 400 kpa and should the difference E be more than 100 Kpa but not more than 150 kPa, the duty ratio of the motor 22*m* may be set to 45%, and so on and so forth as shown for the various other possible combinations as shown in FIG. 10. However, although not shown in the table, should the difference E be more than 600 kPa and/or should the provisional target fuel pressure value Ps is more than 600 kPa, the duty ratio of the motor 22 may be set to a maximum possible duty ratio of 80%.

For example, at time T01 after elapse of a predetermined duration from time T0 and prior to elapse of the period Ams from time T0 as shown in FIG. 8, the actual and/or observed fuel pressure P may still has not been increased to reach the provisional target fuel pressure value Ps. Thus, a determination at Step S221 in FIG. 9 may be "No", and a determination at Step S222 may also be "No." Next, the process shown in FIG. 9 may proceed to Step S223. Step S223 may set the duty ratio of the motor 22*m* of the fuel pump 22 to a pre-set value determined based on the difference E and the provisional target fuel pressure value Ps shown in FIG. 10. Should the actual and/or observed fuel pressure P reach the provisional target fuel pressure value Ps at time T02 in FIG. 8, the determination at Step S222 may be "Yes", so that the low-pressure controller 24 may perform feedback control to adjust and/or maintain the fuel pressure P across the fuel-supply system 10 based on the provisional target fuel pressure value Ps at Step S224 in FIG. 9. Should the period Ams have elapsed at time T1 after the ignition switch has been turned on at time T0, the determination at Step S221 may be "Yes", so that the low-pressure controller 24 may perform feedback control to adjust and/or maintain the fuel pressure P across the fuel-supply system 10 based on the target fuel pressure value Pe1 transmitted from the ECU 40 at Step S225 in FIG. 9. Therefore, even in the case that the difference E between the provisional target pressure value Ps and the actual and/or observed fuel pressure P is relatively large, the duty ratio of the motor 22*m* may not increase to a maximum duty ratio of 100%.

The above-described embodiments may be modified further in various ways. For example, the embodiments have been described for the fuel supply system 10 having the low-pressure fuel pump unit 20 connected in series to the high-pressure fuel pump unit 30. However, the above teachings may be also modified and/or applied as necessary to accommodate a fuel supply system with only a single fuel pump unit. Further, the above teachings may be modified and/or applied to engines other than that engine of a traditional automobile, such as that may be found powering hybrid vehicles, trains, ships and/or any other type of potentially applicable machine, apparatus and/or piece of equipment.

Representative, non-limiting examples were described above in detail with reference to the attached drawings. The detailed description is intended to teach a person of skill in the art details for practicing aspects of the present teachings and thus is not intended to limit the scope of the invention. Furthermore, each of the additional features and teachings disclosed above may be applied and/or utilized separately or in conjunction with other features and teachings to provide improved fuel supply systems, and methods of making and using the same.

Moreover, the various combinations of features and steps disclosed in the above detailed description may not be necessary to practice the invention in the broadest sense, and are instead taught to describe representative examples of the invention. Further, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed as informational, instructive and/or representative and may thus be construed separately and independently from each other. In addition, all value ranges and/or indications of groups of entities are also intended to include possible intermediate values and/or intermediate entities for the purpose of original written disclosure, as well as for the purpose of restricting the claimed subject matter.

What is claimed is:

1. A fuel-supply system, comprising:

a fuel pump powered by a motor wherein the fuel pump supplies fuel from a fuel tank to an engine;

a pressure controller that performs feedback control of a voltage of an electric power applied to the motor to adjust an observed fuel pressure of the fuel to approach a first target fuel pressure value;

a signal output device that outputs the first target fuel pressure value to the pressure controller; and a power switch coupled to a power source that is configured to supply the electric power wherein activation of the power switch allows the electric power to be supplied to the pressure controller, the motor and the signal output device; and further wherein the pressure controller is configured to perform feedback control of the voltage applied to the motor based on a second target fuel pressure value to adjust the observed fuel pressure of the fuel until the first target fuel pressure value is outputted from the signal output device to the pressure controller after the power switch is activated wherein:

the pressure controller is configured to determine the second target fuel pressure based on:

the first target fuel pressure value outputted from the signal output device to the pressure controller at a time immediately before the power switch has been deactivated at the last occasion; and the first target fuel pressure value first outputted from the signal output device to the pressure controller at a time after the power switch is activated at the last occasion.

2. A fuel-supply system, comprising:

a fuel pump powered by a motor wherein the fuel pump supplies fuel from a fuel tank to an engine;

a pressure controller that performs feedback control of a voltage of an electric power applied to the motor to adjust an observed fuel pressure of the fuel to approach a first target fuel pressure value;

a signal output device that outputs the first target fuel pressure value to the pressure controller; and a power switch coupled to a power source that is configured to supply the electric power wherein activation of the power switch allows the electric power to be supplied to the pressure controller, the motor and the signal output device; and further wherein the pressure controller is configured to perform feedback control of the voltage applied to the motor based on a second target fuel pressure value to adjust the observed fuel pressure of the fuel until the first target fuel pressure value is outputted from the signal output device to the pressure controller after the power switch is activated;

wherein:

the pressure controller is configured to set a duty ratio of the voltage applied to the motor to a set value until the observed fuel pressure reaches the second fuel pressure value after the power switch is activated; and further wherein the set value is determined according to a time elapsed after the power switch is activated.

3. A fuel supply system comprising:

a fuel pump powered by a motor and configured to pump fuel from a fuel tank to an engine;

a pressure controller in communication with the fuel pump wherein the pressure controller is configured to perform feedback control of a voltage applied to the motor such that an observed fuel pressure of the fuel pumped from the fuel pump approaches a target fuel pressure value;

wherein the target fuel pressure value includes a first target fuel pressure value and a second target fuel pressure value; and a signal output device that is configured to output the first target fuel pressure value to the pressure controller after elapse of a delay period from application of the voltage to the motor to activate the motor, and further wherein the pressure controller is configured to adjust the observed fuel pressure of the fuel by feedback control to approach the first target fuel pressure value after the pressure controller receives the first target fuel pressure value from the signal output device, wherein the pressure controller still further is configured to adjust the observed fuel pressure of the fuel by feedback control to approach the second target fuel pressure value during the delay period.

4. The system of claim 3 wherein the pressure controller is configured to determine the second target fuel pressure value based on the first target fuel pressure value received from the signal output device when the voltage has been applied to the motor for activating the motor at the last time.

5. The system of claim 3 wherein the pressure controller is configured to drive the motor with a predetermined ratio until the observed fuel pressure matches the second target fuel pressure during the delay period.

6. The system of claim 5 wherein the pressure controller is configured to determine the predetermined duty ratio according to a time elapsed after activating the motor.

7. The system of claim 5 wherein the pressure controller is configured to determine the predetermined duty ratio based on at least one of the second target fuel pressure and a difference between the second target fuel pressure and the actual pressure.

* * * * *